US010316762B2

(12) United States Patent
Murasaka

(10) Patent No.: US 10,316,762 B2
(45) Date of Patent: Jun. 11, 2019

(54) ELECTRONICALLY CONTROLLED THROTTLE DEVICE

(71) Applicant: MIKUNI CORPORATION, Tokyo (JP)

(72) Inventor: Riki Murasaka, Odawara (JP)

(73) Assignee: MIKUNI CORPORATION, Tokyo (JP)

( * ) Notice: Subject to any disclaimer, the term of this patent is extended or adjusted under 35 U.S.C. 154(b) by 149 days.

(21) Appl. No.: 15/120,316

(22) PCT Filed: Feb. 19, 2015

(86) PCT No.: PCT/JP2015/054630
§ 371 (c)(1),
(2) Date: Aug. 19, 2016

(87) PCT Pub. No.: WO2015/125869
PCT Pub. Date: Aug. 27, 2015

(65) Prior Publication Data

US 2017/0058789 A1 Mar. 2, 2017

(30) Foreign Application Priority Data

Feb. 21, 2014 (JP) ..... 2014-031870

(51) Int. Cl.
*F02D 9/08* (2006.01)
*F02D 9/10* (2006.01)

(52) U.S. Cl.
CPC ..... *F02D 9/1065* (2013.01); *F02D 9/107* (2013.01); *F02D 9/1095* (2013.01)

(58) Field of Classification Search
CPC ..... F02D 9/1065; F02D 9/107; F02D 9/1095; F02D 9/08
(Continued)

(56) References Cited

U.S. PATENT DOCUMENTS 5,651,343 A * 7/1997 Evans ..... F02D 17/04 123/336
8,113,168 B2 * 2/2012 Yamada ..... F02B 75/22 123/336
(Continued)

FOREIGN PATENT DOCUMENTS

EP 1 555 408 A1 7/2005
JP 2009-41478 2/2009
(Continued)

OTHER PUBLICATIONS

International Search Report dated Apr. 7, 2015 in corresponding International Application No. PCT/JP2015/054630.
(Continued)

*Primary Examiner* — Hai H Huynh
*Assistant Examiner* — Gonzalo Laguarda

(57) ABSTRACT

Spigots are respectively formed on engine sides of intake passages defined in a first throttle body and intake passages defined in a second throttle body, and end parts of rubber joints extending from individual cylinders of an engine are fitted to corresponding spigots and are fastened and fixed thereto with hose bands. A gear unit is disposed between both throttle bodies and drives and rotates a throttle shaft with a motor via the gear unit to open and close throttle valves of the cylinders. Axis lines of the spigots of the intake passages positioned on both sides of the gear unit are formed to have eccentricity in a direction away from each other, so that a part of the gear unit is positioned between the spigots. Therefore, attachment spaces of the rubber joints are secured without elongating the throttle bodies.

8 Claims, 6 Drawing Sheets

(58) Field of Classification Search
USPC ..... 123/336, 337
See application file for complete search history.

(56) References Cited

U.S. PATENT DOCUMENTS

| | | | | |
|---|---|---|---|---|
| 2003/0047703 | A1* | 3/2003 | Patterson | F02D 9/08 251/301 |
| 2010/0050984 | A1 | 3/2010 | Kato | |
| 2013/0133617 | A1* | 5/2013 | Machida | F02D 9/109 123/336 |

FOREIGN PATENT DOCUMENTS

| | | |
|---|---|---|
| JP | 2010-53713 | 3/2010 |
| JP | 4751366 | 8/2011 |
| JP | 2013-133739 | 7/2013 |

OTHER PUBLICATIONS

Extended European Search Report dated Feb. 8, 2018, in corresponding European Patent Application No. 15752564.3, 8 pgs.

* cited by examiner

ELECTRONICALLY CONTROLLED THROTTLE DEVICE

CROSS-REFERENCE TO RELATED APPLICATIONS

This application is a U.S. National Stage Application, which claims the benefit under 35 U.S.C. § 371 of PCT International Patent Application No. PCT/JP2015/054630, filed Feb. 19, 2015, which claims the foreign priority benefit under 35 U.S.C. § 119 of Japanese Patent Application No. 2014-031870, filed Feb. 21, 2014, the contents of which are incorporated herein by reference.

TECHNICAL FIELD

The present invention relates to an electronically controlled throttle device for a two-wheeled vehicle in which throttle valves are respectively disposed in a plurality of intake passages corresponding to cylinders of an engine, and a throttle shaft is driven and rotated with a motor to synchronously open and close the throttle valves.

BACKGROUND ART

Since excellent throttle response is regarded as important for a two-wheeled vehicle, compared with that for a four-wheeled vehicle, there is sometimes a case where a multiple throttle device is employed as a throttle device to regulate intake air to an engine in response to throttle operation of a driver. In such a multiple throttle device, there is taken a configuration in which intake passages are defined in a throttle body correspondingly to individual cylinders of the engine, throttle valves are disposed in the individual intake passages and supported on a throttle shaft, and the throttle shaft is driven and rotated in response to the throttle operation to synchronously open and close the throttle valves.

Moreover, since many engines mounted on two-wheeled vehicles have high speed rotation-type characteristics and require more precise and appropriate throttle opening adjustment, throttle devices are electronically controlled in recent years. In such a multiple throttle device which is electronically controlled (hereinafter referred to simply as electronically controlled throttle device), the throttle shaft is driven and rotated with a motor via a gear train of a gear unit to open and close the throttle valves. Twist of the throttle shaft in driving and rotating leads to phase displacements of the throttle valves, and eventually, differences in intake air amounts. Hence, the twist of the throttle shaft is suppressed by inputting driving force from the motor to the middle of the throttle shaft in the longitudinal direction.

FIG. 5 is a cross-sectional plan view showing an electronically controlled throttle device of the conventional art as above. FIG. 6 is a partially expanded cross-sectional plan view of the periphery of a gear unit of the same. An electronically controlled throttle device 31 in this example is a quadruple throttle device for a 4-cylinder engine, and its throttle body is divided into a first throttle body 2 and a second throttle body 3, which are connected to each other with not-shown bolts.

A pair of intake passages $\mathbf{5}_{\#1}$ and $\mathbf{5}_{\#2}$ that respectively correspond to a #1 cylinder and a #2 cylinder of an engine are defined in the first throttle body 2, and a pair of intake passages $\mathbf{5}_{\#3}$ and $\mathbf{5}_{\#4}$ that respectively correspond to a #3 cylinder and a #4 cylinder of the engine are defined in the second throttle body 3. A not-shown air cleaner is connected to the intake passages $\mathbf{5}_{\#1}$ to $\mathbf{5}_{\#4}$ on the opposite engine side, and moreover, fuel injection valves 6 show their tips inside the individual intake passages $\mathbf{5}_{\#1}$ to $\mathbf{5}_{\#4}$.

One throttle shaft 8 is rotatably supported in the first and second throttle bodies 2 and 3 so as to penetrate the intake passages $\mathbf{5}_{\#1}$ to $\mathbf{5}_{\#4}$, and throttle valves 10 disposed in the individual intake passages $\mathbf{5}_{\#1}$ to $\mathbf{5}_{\#4}$ are supported on the throttle shaft 8. A gear unit 12 is disposed between the first and second throttle bodies 2 and 3, and a not-shown motor is connected to the gear unit 12. Driving force from the motor is transmitted to the throttle shaft 8 via a gear train 14 built in the gear unit 12, and drives and rotates the throttle shaft 8 to synchronously open and close the throttle valves 10.

Cylindrical spigots 17 are formed at the end parts of the individual intake passages $\mathbf{5}_{\#1}$ to $\mathbf{5}_{\#4}$ on the engine side, the end parts of rubber joints 18 extending from individual intake ports of the engine are respectively fitted to the spigots 17, and they are fastened and fixed thereto with hose bands 19 or the like. Intake air introduced from the air cleaner into the intake passages $\mathbf{5}\#_1$ to $\mathbf{5}_{\#4}$ is mixed with fuel injected from the fuel injection valves 6 while being regulated in its flow rate in response to the degree of throttle opening, and is introduced into the cylinders through the rubber joints 18 and the intake ports of the engine to serve combustion.

A space for fitting the end part of the rubber joint 18 (hereinafter referred to as attachment space of the rubber joint 18) is needed in the periphery of each spigot 17. However, the gear unit 12 which the gear train 14 is built in occupies a significant region in the radial direction with the throttle shaft 8 being as the center. Hence, a part thereof interferes with the spigots 17, which prevents the attachment spaces of the rubber joints 18 from being secured.

Therefore, as shown in FIG. 6, in the electronically controlled throttle device 31 of the conventional art, the total lengths $L_2$ of the throttle bodies 2 and 3 along the intake air flowing direction are elongated to displace the positions of the spigots 17 to the engine side (separate them from the gear unit 12 by a dimension $l_3$), and thereby, the interference with a part of the gear unit 12 is prevented to secure the attachment spaces of the rubber joints 18.

Meanwhile, as such a throttle device in which the throttle body is divided, for example, a technology in Patent Document 1 is proposed. The throttle device in Patent Document 1 employs conventional wire drive, and therein, a connection synchronization mechanism is provided between both throttle bodies. Throttle operation by the driver is transmitted to a throttle shaft of one throttle body via a wire, the rotation of the throttle shaft is transmitted to a throttle shaft of the other throttle body via the connection synchronization mechanism, and the connection synchronization mechanism enables a phase between the throttle shafts to be finely adjusted. Further, in this throttle device, in order to improve flexibility in designing the connection synchronization mechanism, spigots of a pair of intake passages positioned on both sides of the connection synchronization mechanism are formed to have eccentricity downward by a and formed to have eccentricity in a direction away from each other by b.

PRIOR ART DOCUMENT

Patent Document

Patent Document 1: Japanese Patent No. 4751366

SUMMARY OF THE INVENTION

Problems to be Solved by the Invention

As mentioned above, in the conventional art of FIGS. 5 and 6, in order to secure the attachment spaces of the rubber joints 18, the total lengths $L_2$ of the throttle bodies 2 and 3 are elongated in the intake air flowing direction. Nevertheless, to elongate the throttle bodies 2 and 3 causes an obstacle to realizing engine characteristics suitable for a two-wheeled vehicle as well as a factor of large size and weight increase of the electronically controlled throttle device 31.

Namely, as one of various factors affecting the engine characteristics, there is known the length (internal volume) of the intake passage of the throttle device. It is essential for the intake passage to be made short for the characteristics of a high speed rotation-type engine desired in a two-wheeled vehicle. Nevertheless, when the total lengths of the throttle bodies 2 and 3 are elongated in order to secure the attachment spaces of the rubber joints 18, the intake passages $\mathbf{5}_{\#1}$ to $\mathbf{5}_{\#4}$ are also elongated, which causes the electronically controlled throttle device 31 to have improper specifications in view of the characteristics of a high speed rotation-type engine.

In order to reduce the total lengths $L_2$ of the throttle bodies 2 and 3 to be compatible with the characteristics of a high speed rotation-type engine, the gear unit 12 is needed to be downsized. However, the following reason makes downsizing the gear unit 12 exceedingly difficult.

In the connection synchronization mechanism, for example, in Patent Document 1, an adjustment bolt is provided at a position eccentric from the rotational axis line of one throttle shaft, and a synchronization plate is provided at a position eccentric from the rotational axis line of the other throttle shaft so as to correspond to the tip of the adjustment bolt. When the one throttle shaft rotates, the tip of the adjustment bolt transmits the rotation to the other throttle shaft while pressing the synchronization plate, and in this way, both throttle shafts synchronously rotate. For such rotation transmission, the adjustment bolt and the synchronization plate are needed to be formed to have eccentricity with respect to the rotational axis lines of the throttle shafts, which causes the connection synchronization mechanism to be larger as the eccentric amount is larger. Nevertheless, since the rotation transmission can be performed without any problems in the presence of a certain eccentric amount, the connection synchronization mechanism can be easily downsized.

On the contrary, in the conventional art of FIGS. 5 and 6, since the throttle valves 10 are opened and closed against the air flowing in the intake passages $\mathbf{5}_{\#1}$ to $\mathbf{5}_{\#4}$, the motor, which is the driving source, is needed to provide large torque. The motor is larger as the torque increases more, which eventually causes the whole electronically controlled throttle device to be larger. In order to prevent the motor from being large, the motor torque can be supplied by increasing a deceleration ratio of the gear unit 12, but the increase of the deceleration ratio causes the gear unit 12 to be large. Namely, there is a trade-off between downsizing the motor and downsizing the gear unit, only one of those cannot be given priority, and this is a factor of preventing the gear unit 12 from being downsized.

As above, the gear unit 12 of the conventional art is largely different from the connection synchronization mechanism disclosed in Patent Document 1 in that it cannot be easily downsized, and consequently, the problems thereof cannot be solved simply with a measure that the spigots are formed to have eccentricity as disclosed in Patent Document 1. As a result, in the conventional art of FIGS. 5 and 6, the large gear unit 12 has to be disposed between both throttle bodies 2 and 3. Thus, to elongate the total lengths $L_2$ of the throttle bodies 2 and 3 for securing the attachment spaces of the rubber joints 18 has problematically caused impossibility in realizing specifications suitable for characteristics of a high speed rotation-type engine.

The present invention is devised in order to solve such problems and an object thereof is to provide an electronically controlled throttle device in which attachment spaces of rubber joints can be secured in the peripheries of spigots without elongating throttle bodies in the intake air flowing direction in the layout of a gear unit disposed between the throttle bodies, and accordingly with which specifications suitable for characteristics of a small and lightweight high speed rotation-type engine can be realized while maintaining excellent assembly ability.

Means for Solving the Problems

In order to achieve the aforementioned object, there is provided an electronically controlled throttle device of the present invention, including: a pair of throttle bodies that are disposed adjacent to each other and in each of which an intake passage corresponding to each cylinder of an engine is defined; spigots that are respectively formed in engine-side end parts of the intake passages of the throttle bodies, axis lines of which are formed to have eccentricity in a direction away from each other with axis lines of the intake passages being as references, and to each of which one end of a joint member extending from the corresponding cylinder of the engine is fitted; a throttle shaft rotatably supported in the throttle bodies and supporting throttle valves respectively disposed in the intake passages; and a gear unit that is disposed between the throttle bodies to be connected to the throttle shaft, drives and rotates the throttle shaft with driving force from a motor via a built-in gear train to be capable of synchronously opening and closing the throttle valves, and a part of which is positioned between the spigots of the throttle bodies.

According to the electronically controlled throttle device configured as above, in the layout of the gear unit disposed between the throttle bodies, the total lengths of the throttle bodies in the intake air flowing direction are reduced, and the attachment spaces of the joint members can be secured in the peripheries of both spigots.

As another aspect, it is preferable that a part of the gear unit protrudes beyond ends of the spigots of the throttle bodies to the engine side.

According to the electronically controlled throttle device configured as above, a larger gear unit can be disposed between the throttle bodies, and the total lengths of the throttle bodies can be further reduced.

As another aspect, it is preferable that a plurality of intake passages are formed in each of the throttle bodies, and only axis lines of a pair of spigots positioned on both sides of the gear unit out of the spigots respectively formed in the engine-side end parts of the intake passages are formed to have eccentricity in the direction away from each other.

According to the electronically controlled throttle device configured as above, since only the axis lines of the pair of spigots positioned on both sides of the gear unit have eccentricity in the direction away and the axis lines of the other spigots do not have eccentricity, a situation that the space occupied by the spigots of the cylinders increases can be prevented, which enables further downsizing.

As another aspect, it is preferable that the gear unit is disposed to have an offset toward any one side of the throttle bodies from a central position between axis lines of a pair of intake passages positioned on both sides of the gear unit, and that eccentric amounts of the axis lines of the spigots with respect to the respective axis lines of the pair of intake passages are configured such that the eccentric amount of the axis line of the spigot positioned on the one side of the gear unit is larger than the eccentric amount of the axis line of the spigot positioned on the other side of the gear unit.

According to the electronically controlled throttle device configured as above, since the eccentric amounts of the axis lines of the spigots positioned on both sides are configured to be uneven depending on the offset state of the gear unit, the attachment spaces can be more definitely secured in the peripheries of the spigots.

Advantageous Effects of the Invention

According to the present invention, attachment spaces of joint members can be secured in the peripheries of spigots without elongating throttle bodies in the intake air flowing direction in the layout of a gear unit provided between the throttle bodies, and accordingly, specifications suitable for characteristics of a small and lightweight high speed rotation-type engine can be realized while maintaining excellent assembly ability.

MODE FOR CARRYING OUT THE INVENTION

Hereafter, an embodiment of an electronically controlled throttle device obtained by embodying the present invention is described.

Figure 1:
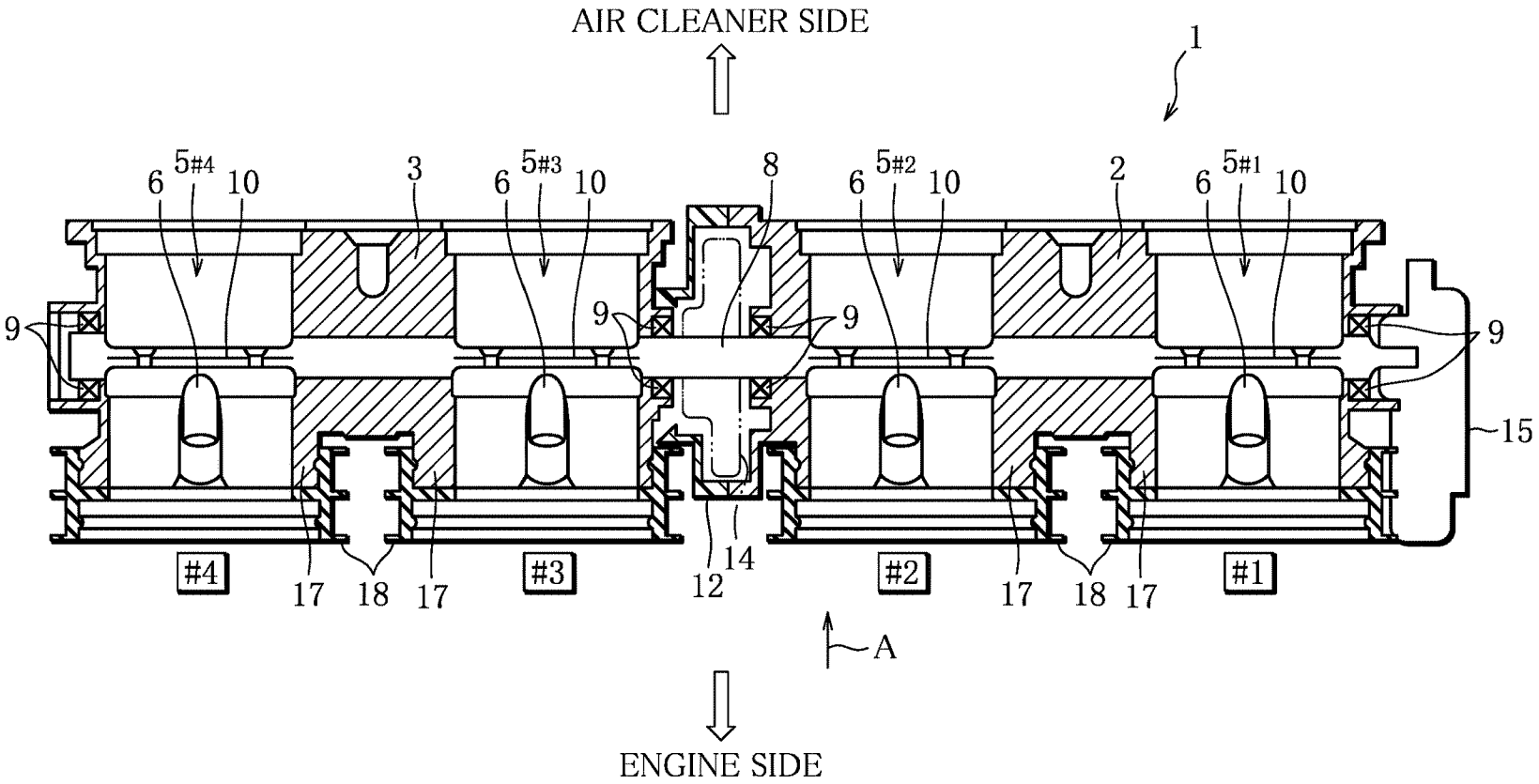
FIG. 1 is a cross-sectional plan view showing an electronically controlled throttle device of an embodiment.
Figure 2:
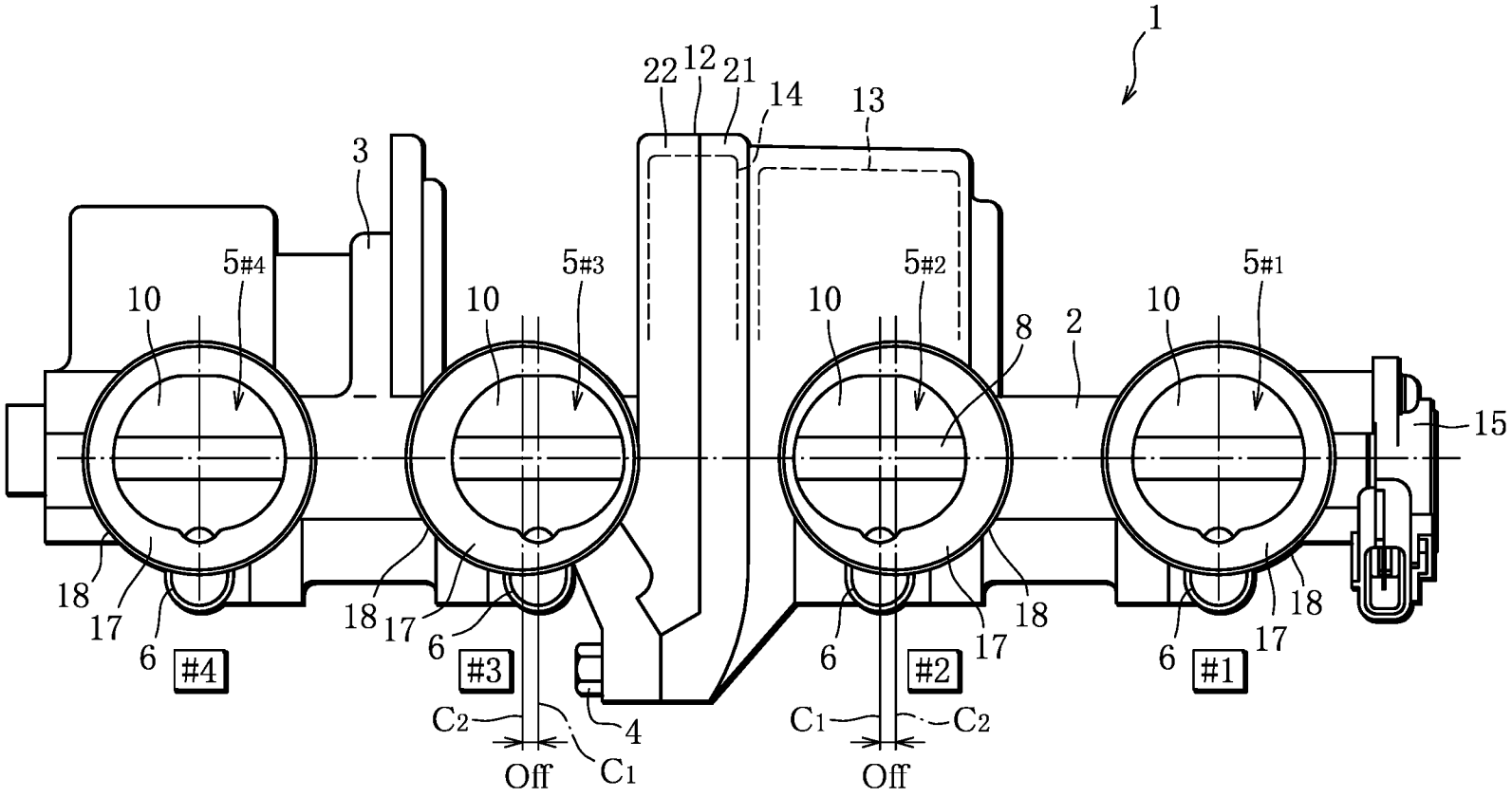
FIG. 2 is a view of the electronically controlled throttle device as seen from the engine side through the arrow A in FIG. 1.
Figure 3:
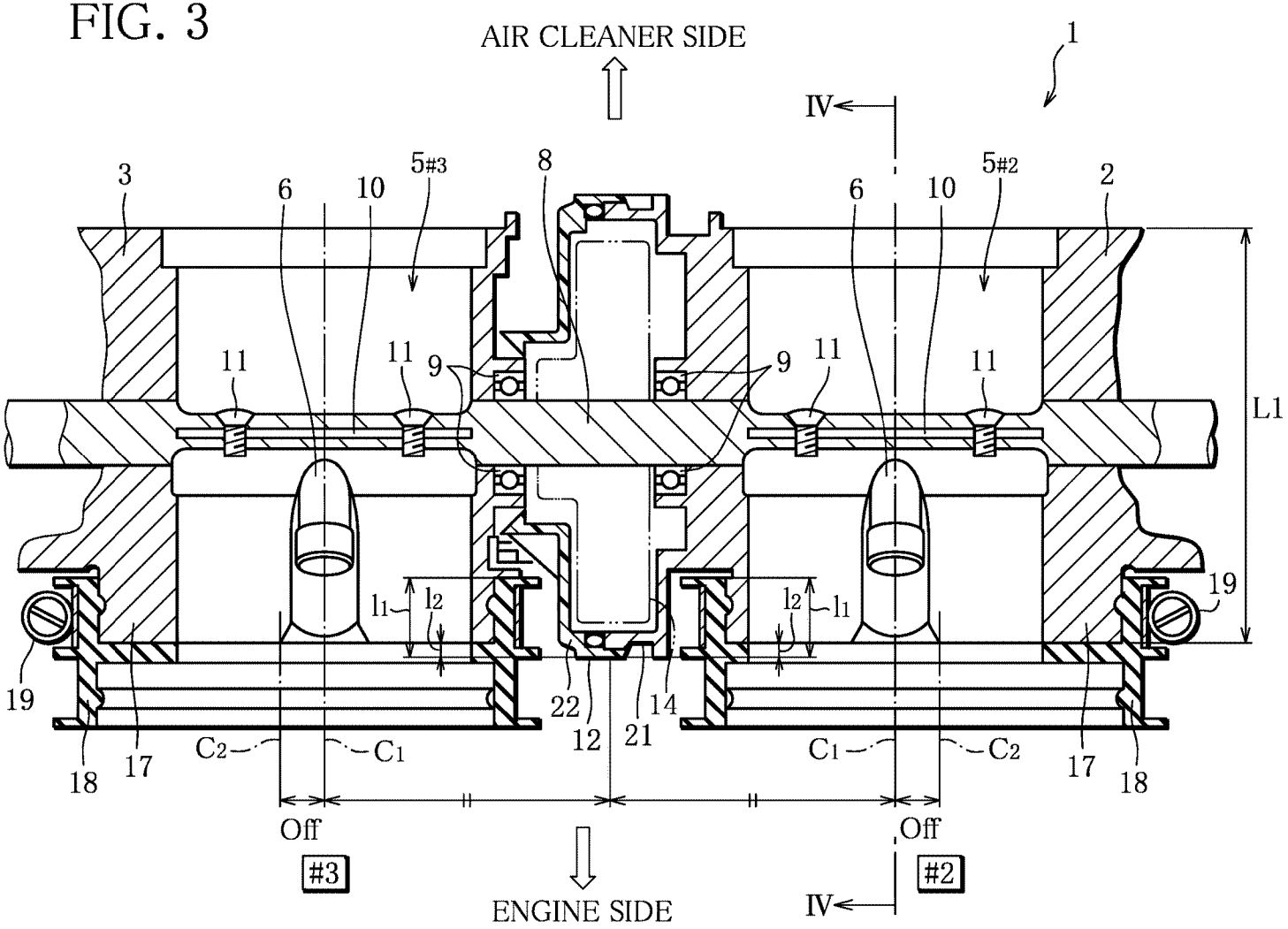
FIG. 3 is a partially expanded cross-sectional plan view of the periphery of a gear unit of the same.
Figure 4:
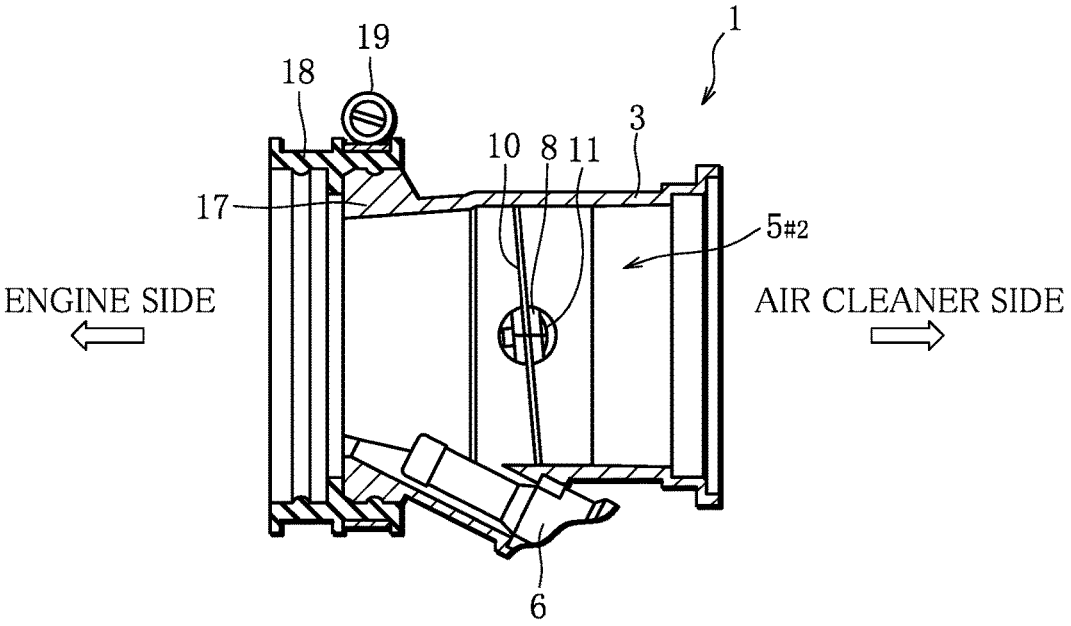
FIG. 4 is a cross-sectional view taken along the IV-IV line in FIG. 3.

FIG. 1 is a cross-sectional plan view showing an electronically controlled throttle device of the present embodiment. FIG. 2 is a view of the electronically controlled throttle device as seen from the engine side through the arrow A in FIG. 1. FIG. 3 is a partially expanded cross-sectional plan view of the periphery of a gear unit of the same. FIG. 4 is a cross-sectional view taken along the IV-IV line in FIG. 3. In FIG. 1, an electronic throttle control device in the posture of being mounted on a two-wheeled vehicle is seen from the upper side, and not shown, an engine is positioned on the downside in the figure and an air cleaner is positioned on the upside therein. In the following description, the direction perpendicular to the page of FIG. 1 is defined as being vertical, the right-left direction in FIG. 1 as being horizontal (direction in which cylinders are provided to line up), the downside in FIG. 1 as being on the engine side, and the upside therein as being on the air cleaner side.

As shown in FIGS. 1, 2 and 4, an electronically controlled throttle device 1 of the present embodiment is configured as a quadruple throttle device for a 4-cylinder engine. A throttle body of the electronically controlled throttle device 1 is composed of a first throttle body 2 and a second throttle body 3, and these throttle bodies 2 and 3 are produced by aluminum die casting and are connected to each other with a plurality of bolts 4 (FIG. 2 shows one of these).

A pair of intake passages $\mathbf{5}_{\#1}$ and $\mathbf{5}_{\#}2$ that respectively correspond to a #1 cylinder and a #2 cylinder of the engine and have circular cross sections are defined in the first throttle body 2, and a pair of intake passages $\mathbf{5}_{\#3}$ and $\mathbf{5}_{\#4}$ that respectively correspond to a #3 cylinder and a #4 cylinder of the engine and have circular cross sections are defined in the second throttle body 3. The intake passages $\mathbf{5}_{\#1}$ to $\mathbf{5}_{\#4}$ are provided to line up at predetermined pitches in the horizontal direction correspondingly to the individual cylinders of the engine.

A common air cleaner is connected to the intake passages $\mathbf{5}_{\#1}$ to $\mathbf{5}_{\#4}$ on the opposite engine side, and during operation of the engine, the air filtered through the air cleaner is introduced into the intake passages $\mathbf{5}_{\#1}$ to $\mathbf{5}_{\#4}$. As shown in FIG. 4, fuel injection valves 6 are attached to the individual intake passages $\mathbf{5}_{\#1}$ to $\mathbf{5}_{\#4}$ of the first and second throttle bodies 2 and 3 at the downside positions so as to show their tips inside the intake passages $\mathbf{5}_{\#1}$ to $\mathbf{5}_{\#4}$, and during operation of the engine, fuel is injected from the fuel injection valves 6 into the intake passages $\mathbf{5}_{\pi1}$ to $\mathbf{5}_{\#4}$ in response to a drive signal from a not-shown ECU (engine control unit). Notably, in the case where the engine is configured as cylinder injection-type one, the fuel injection valves 6 corresponding to the individual cylinders are omitted.

One throttle shaft 8 is rotatably supported on bearings 9 in the first and second throttle bodies 2 and 3, and the throttle shaft 8 extends in the horizontal direction so as to penetrate the intake passages $\mathbf{5}_{\#1}$ to $\mathbf{5}_{\#4}$. Throttle valves 10 are disposed in the individual intake passages $\mathbf{5}_{\#1}$ to $\mathbf{5}_{\#4}$, and these throttle valves 10 are fixed to the throttle shaft 8 with individual pairs of screws 11.

As shown in FIGS. 1 to 3, a gear unit 12 is disposed between the first and second throttle bodies 2 and 3, and a motor 13 (illustrated with a broken line in FIG. 2) is built in the first throttle body 2. Not shown, the output shaft of the motor 13 is connected to one end of a gear train 14 (illustrated with a broken line in FIGS. 2 and 3) which is built in the gear unit 12 and constituted of a plurality of gears, and the other end of the gear train 14 is connected to the throttle shaft 8 in the gear unit 12. Driving force from the motor 13 is transmitted to the throttle shaft 8 via the gear train 14 of the gear unit 12, and drives and rotates the throttle shaft 8 to synchronously open and close the throttle valves 10.

A throttle opening sensor 15 is attached to the right end of the throttle shaft 8, protruding from the first throttle body 2, and the throttle opening sensor 15 detects an actual degree of throttle opening. During operation of the engine, the motor 13 is controlled and driven by the ECU, and the ECU determines a target degree of throttle opening from a throttle operation amount by a driver and controls and drives the motor 13 based on its comparison with the actual degree of throttle opening to adjust the degree of throttle opening.

As shown in FIGS. 2 and 3, cylindrical spigots 17 are integrally formed at the end parts of the individual intake passages $\mathbf{5}_{\#1}$ to $\mathbf{5}_{\#4}$ of the first and second throttle bodies 2 and 3 on the engine side. To each spigot 17, one end of a short cylindrical rubber joint 18 (joint member) is fitted, and it is fastened and fixed with respect to the spigot 17 with a hose band 19. Moreover, not shown, the other end of each rubber joint 18 is fitted to an intake port of the corresponding cylinder of the engine, and similarly fastened and fixed thereto with a hose band.

In this way, four intake paths are formed from the air cleaner through the intake passages $\mathbf{5}_{\#1}$ to $\mathbf{5}_{\#4}$ and the rubber joints 18 to the intake ports of the engine. Accordingly, during operation of the engine, intake air from the air cleaner is introduced into each of the intake passages $\mathbf{5}_{\#1}$ to $\mathbf{5}_{\#4}$ of the electronically controlled throttle device 1, is mixed with fuel injected from the fuel injection valve 6 while being regulated in its flow rate in response to the degree of throttle opening, and is introduced into each cylinder through the rubber joint 18 and the intake port of the engine to serve combustion.

Figure 5:
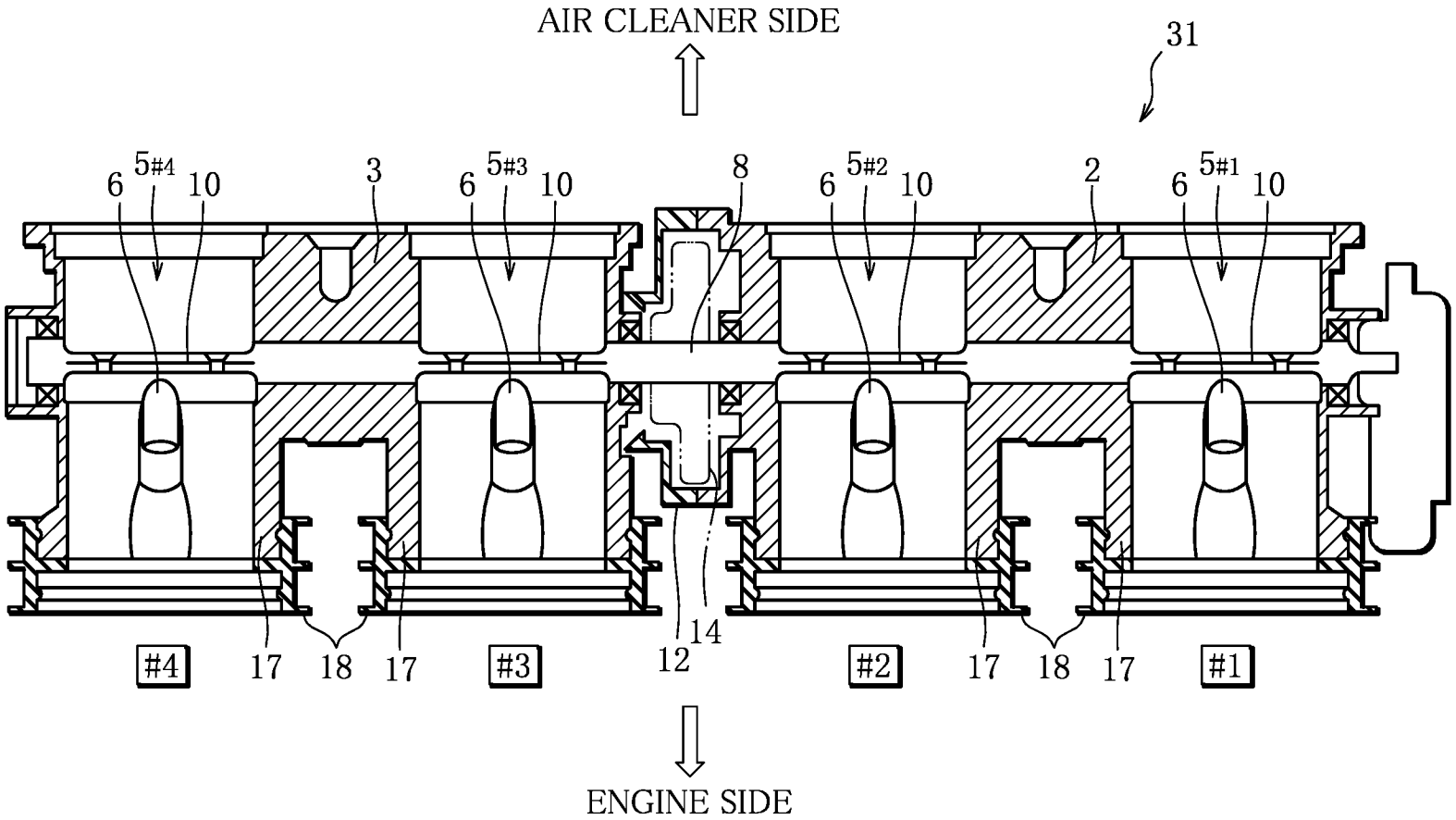
FIG. 5 is a cross-sectional plan view showing an electronically controlled throttle device of a conventional art.
Figure 6:
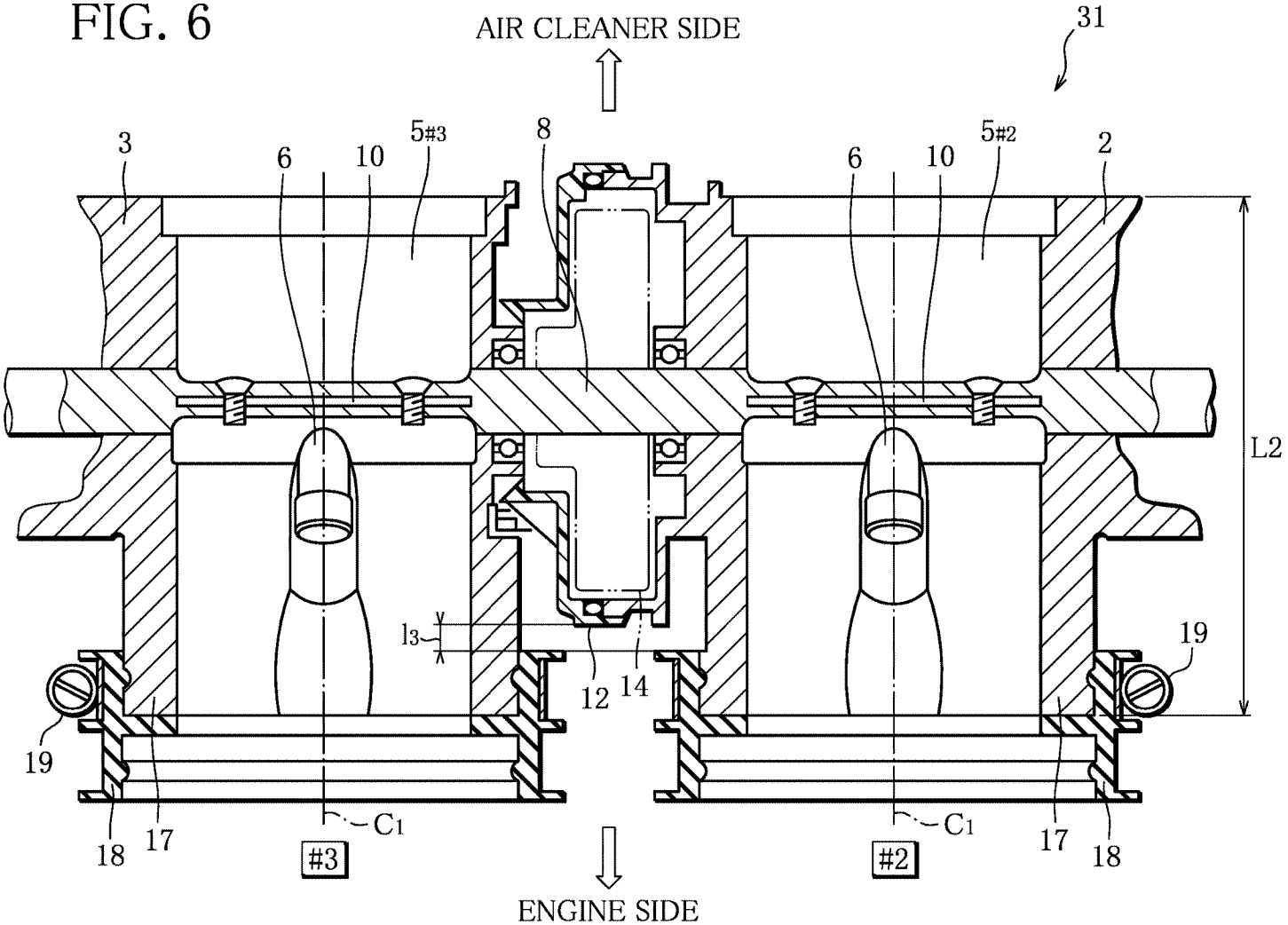
FIG. 6 is a partially expanded cross-sectional plan view of the periphery of a gear unit of the same conventional art.

Now, as mentioned in [Problems to be Solved by the Invention], the attachment space of the rubber joint 18 is needed in the periphery of each spigot 17. A large gear unit 12 disposed between the throttle bodies 2 and 3 would prevent the attachment space from being secured. Therefore, the conventional art of FIGS. 5 and 6 takes a measure that the total lengths $L_2$ of the throttle bodies 2 and 3 along the intake air flowing direction are elongated to displace the positions of the spigots 17 to the engine side. Nevertheless, this causes a new problem of not being able to be compatible with characteristics of a high speed rotation-type engine.

In view of such problems, the inventor has found that the attachment spaces of the rubber joints 18 can be secured without elongating the total lengths of the throttle bodies 2 and 3 when axis lines $C_2$ of the spigots 17 of the #2 cylinder and the #3 cylinder positioned on horizontal both sides of the gear unit 12 are formed to have eccentricity in a direction away from each other, and a part of the gear unit 12 is positioned between those spigots 17. With this knowledge, in the present embodiment, the axis lines $C_2$ of the spigots 17 are formed to have eccentricity with respective axis lines $C_1$ of the intake passages $\mathbf{5}_{\#}2$ and $\mathbf{5}_{\#3}$ of the #2 cylinder and the #3 cylinder being as references. Hereafter, the details are described.

First, before the description on the eccentricity of the axis lines $C_2$ of the spigots 17, details of the gear unit 12 disposed between both throttle bodies 2 and 3 are mentioned.

As shown in FIGS. 2 and 3, the left-side face of the first throttle body 2 and the right-side face of the second throttle body 3 are separate from each other, and in a space formed between these, the gear unit 12 is disposed. A right-side casing 21 is integrally formed on the left-side face of the first throttle body 2, and the right-side casing 21 has a shape which opens leftward with the throttle shaft 8 being the center. A synthetic resin-made left-side casing 22 is disposed leftward of the right-side casing 21, and the left-side casing 22 has a shape which opens rightward with the throttle shaft 8 being the center.

The left-side and right-side casings 21 and 22 are connected to each other with not-shown screws in the state where their outer circumferential edges are in contact with each other, and in this way, the casing of the gear unit 12 is formed. Further, as mentioned above, the gear train 14 is disposed in the casings 21 and 22 and the power transmission from the motor 13 to the throttle shaft 8 is performed.

As apparent from FIG. 3, the gear unit 12 which the gear train 14 is built in occupies a significant region in the radial direction with the throttle shaft 8 being as the center, and meanwhile, the throttle bodies 2 and 3 of the present embodiment are configured to have short total lengths $L_1$ ($<L_2$) such that they are compatible with characteristics of a high speed rotation-type engine.

As a result, a part of the gear unit 12 not only protrudes beyond the basal ends of the spigots 17 (end parts of the rubber joints 18 on the air cleaner side) to the engine side by a dimension $l_1$, but also further protrudes beyond the tip ends of the spigots 17 to the engine side by a dimension $l_2$ in the intake air flowing direction. In this positional relation, while a part of the gear unit 12 (place thereof on the engine side) is to cause its interference with the spigots 17 of the #2 cylinder and the #3 cylinder positioned on horizontal both sides thereof, eccentricity of the spigots 17 mentioned below prevents interference.

First, the spigots 17 corresponding to the #1 cylinder and the #4 cylinder are normally formed with the axis lines $C_1$ of the intake passages $\mathbf{5}_{\#1}$ and $\mathbf{5}_{\#4}$ being as their centers. On the contrary, the axis lines $C_2$ of the spigots 17 corresponding to the #2 cylinder and the #3 cylinder have eccentricity in the direction away from each other with the respective axis lines $C_1$ of the intake passages $\mathbf{5}_{\#}2$ and $\mathbf{5}_{\#3}$ being as references. In detail, the axis line $C_2$ of the spigot 17 of the #2 cylinder has eccentricity rightward by an eccentric amount Off with the axis line $C_1$ of the intake passage $\mathbf{5}_{\#}2$ being as a reference, and the axis line $C_2$ of the spigot 17 of the #3 cylinder has eccentricity leftward by the eccentric amount Off with the axis line $C_1$ of the intake passage $\mathbf{5}_{\#3}$ being as a reference. As a result, a part of the gear unit 12 is to be positioned between the spigots 17 of the #2 cylinder and the #3 cylinder.

The eccentric amounts Off are configured such that the attachment spaces of the rubber joints 18 can be respectively secured in the peripheries of the spigots 17 of the #2 cylinder and the #3 cylinder with the position of the gear unit 12 in the horizontal direction taken into consideration. As shown in FIG. 3, in the present embodiment, the gear unit 12 is disposed at the central position between the axis line $C_1$ of the intake passage $\mathbf{5}_{\#}2$ of the #2 cylinder and the axis line $C_1$ of the intake passage $\mathbf{5}_{\#3}$ of the #3 cylinder. Due to this, the eccentric amount Off needed for securing the attachment space is the same for both of the spigot 17 of the #2 cylinder and the spigot 17 of the #3 cylinder, for which the same eccentric amount Off is configured.

As above, according to the electronically controlled throttle device 1 of the present embodiment, the axis lines $C_2$ of the spigots 17 of the #2 cylinder and the #3 cylinder positioned on horizontal both sides of the gear unit 12 are formed to have eccentricity in the direction away from each other with the axis lines $C_1$ of the intake passages $\mathbf{5}_{\#}2$ and $\mathbf{5}_{\#3}$ being as references, and a part of the gear unit 12 is positioned between those spigots 17. Due to this, the total lengths $L_1$ of the throttle bodies 2 and 3 in the intake air flowing direction can be reduced, and the attachment spaces of the rubber joints 18 can be secured in the peripheries of the spigots 17 of the #2 cylinder and the #3 cylinder.

As a result, in the layout of the gear unit 12 disposed between the throttle bodies 2 and 3, specifications of the electronically controlled throttle device 1 suitable for characteristics of a small and lightweight high speed rotation-type engine can be realized while maintaining excellent assembly ability.

Besides, in the present embodiment, a part of the gear unit 12 not only protrudes beyond the basal ends of the spigots 17 to the engine side, but also further protrudes beyond the tip ends of the spigots 17 to the engine side. Therefore, a larger gear unit 12 can be disposed between both throttle bodies 2 and 3, and the total lengths $L_1$ of the throttle bodies 2 and 3 can be further reduced.

Furthermore, in the present embodiment, only the axis lines $C_2$ of the spigots 17 of the #2 cylinder and the #3 cylinder positioned on both sides of the gear unit 12 out of the spigots of the intake passages of the #1 cylinder to the #4 cylinder are formed to have eccentricity in the direction away from each other. As a result, although the spigot 17 of the #2 cylinder comes close to the spigot 17 of the #1 cylinder and the spigot 17 of the #3 cylinder comes close to the spigot 17 of the #4 cylinder, obstacles like the gear unit 12 are not present respectively between the spigots 17, and hence, the attachment spaces of the rubber joints 18 can be secured without any problems.

Further, supposing that the axis lines $C_2$ of the spigots 17 of the #1 cylinder and the #4 cylinder would be also formed to have eccentricity correspondingly to the eccentricity of the axis lines $C_2$ of the spigots 17 of the #2 cylinder and the #3 cylinder, a space occupied by the spigots 17 of the cylinders would increase in the horizontal direction. Nevertheless, the axis lines $C_2$ of the spigots 17 of the #1 cylinder and the #4 cylinder are not formed to have eccentricity, and hence, such a situation can be prevented and the electronically controlled throttle device 1 can be further downsized.

As above, while the description of the embodiment has been completed, aspects of the present invention are not limited to this embodiment. For example, while in the aforementioned embodiment, the first throttle body 2 having the pair of intake passages $\mathbf{5}_{\#1}$ and $\mathbf{5}_{\#}2$ and the second throttle body 3 having the pair of intake passages $\mathbf{5}_{\#3}$ and $\mathbf{5}_{\#4}$ are connected to constitute the quadruple electronically controlled throttle device 1, there is no limitation to this.

For example, a single intake passage may be defined in each of the first and second throttle bodies 2 and 3 to connect these throttle bodies 2 and 3, constituting a double electronically controlled throttle device 1. A pair of intake passages may be defined in the first throttle body 2 and three intake passages in the second throttle body 3 to connect these throttle bodies 2 and 3, constituting a quintuple electronically controlled throttle device 1. Even in such cases, when the axis lines $C_2$ of the spigots 17 on both sides of the gear unit 12 disposed between both throttle bodies 2 and 3 are formed to have eccentricity in the direction away, completely the same effects as those of the aforementioned embodiment can be obtained.

Moreover, while in the aforementioned embodiment, the right-side casing 21 is integrally formed on the left-side face of the first throttle body 2 and the synthetic resin-made left-side casing 22 is connected to the right-side casing 21, affording the casing of the gear unit 12, there is no limitation to this. For example, a general purpose gear unit may be produced completely separately and independently from the first and second throttle bodies 2 and 3 to be commonly used for a plurality of types of electronically controlled throttle devices whose specifications such as the number of cylinders are different from one another.

Moreover, while in the aforementioned embodiment, one throttle shaft 8 is rotatably supported in the first and second throttle bodies 2 and 3 to open and close the throttle valves 10 of the cylinders, there is no limitation to this. For example, the throttle shaft 8 may be divided into the right and the left at the place of the gear unit 12, and both throttle shafts 8 may be configured to be interlinkingly driven and rotated via the connection synchronization mechanism as disclosed in Patent Document 1.

Moreover, while in the aforementioned embodiment, the eccentric amounts Off of the axis lines $C_2$ of the spigots 17 of the #2 cylinder and the #3 cylinder are configured to be the same, there is no limitation to this but different eccentric amounts Off may be configured. For example, the gear unit 12 is not necessarily disposed at the central position between the axis line $C_1$ of the intake passage $\mathbf{5}_{\#}2$ of the #2 cylinder and the axis line $C_1$ of the intake passage $\mathbf{5}_{\#3}$ of the #3 cylinder. Depending on various factors such as a configuration of the gear train 14 inside it and its positional relation to the motor 13, there is a possibility that it is disposed to have an offset more or less toward any one side thereof from the central position between both axis lines $C_1$ in the horizontal direction.

In this case, as compared with the spigot 17 positioned on the other side (side separate from the gear unit 12), the attachment space of the rubber joint 18 is more difficult to be secured for the spigot 17 positioned on the one side (side coming close to the gear unit 12). Therefore, the eccentric amount Off of the axis line $C_2$ of the spigot 17 positioned on the one side of the gear unit 12 may be configured to be larger than the eccentric amount Off of the axis line $C_2$ of the spigot 17 positioned on the other side of the gear unit 12. In this way, when the eccentric amounts Off of the axis lines $C_2$ of the spigots 17 positioned on both sides are configured to be uneven depending on the offset state of the gear unit 12, the attachment spaces can be more definitely secured in the peripheries of the spigots 17.

EXPLANATION OF REFERENCE SIGNS

1 Electronically controlled throttle device
2 First throttle body
3 Second throttle body
$\mathbf{5}_{\#1}$ to $\mathbf{5}_{\#4}$ Intake passages
8 Throttle shaft
10 Throttle valve
12 Gear unit
13 Motor
14 Gear train
17 Spigot
18 Rubber joint (joint member)
$C_1$ and $C_2$ Axis lines
Off Eccentric amount

The invention claimed is:

1. An electronically controlled throttle device comprising:

a first throttle body and a second throttle body that are disposed adjacent to each other and in which a first intake passage and a second intake passage corresponding to each cylinder of an engine are respectively defined;

a first spigot and a second spigot that are respectively formed in engine-side end parts of the first intake passage and the second intake passage, and to each of which one end of a joint member extending from the corresponding cylinder of the engine is fitted;

a throttle shaft rotatably supported in the first throttle body and the second throttle body, and supporting a first throttle valve and a second throttle valve respectively disposed in the first intake passage and the second intake passage; and a gear unit that is disposed between the first throttle body and the second throttle body to be connected to the throttle shaft, drives and rotates the throttle shaft with driving force from a motor via a built-in gear train to be capable of synchronously opening and closing the first throttle valve and the second throttle valve, and a part of which is positioned between the first spigot and the second spigot, wherein a central axis line of the first spigot in parallel to a central axis line of the first intake passage is eccentric with respect to the central axis line of the first intake passage in a direction away from a central axis line of the second spigot, and the central axis line of the second spigot in parallel to a central axis line of the second intake passage is eccentric with respect to the central axis line of the second intake passage in a direction away from the central axis line of the first spigot.

2. The electronically controlled throttle device according to claim 1, wherein a part of the gear unit protrudes beyond ends of the first spigot and the second spigot to the engine side.

3. The electronically controlled throttle device according to claim 1, wherein a plurality of intake passages are formed in each of the first throttle body and the second throttle body, and only central axis lines of the first spigot and the second spigot positioned on both sides of the gear unit out of spigots respectively formed in the engine-side end parts of the intake passages are eccentric in the direction away from each other.

4. The electronically controlled throttle device according to claim 1, wherein the gear unit is disposed to have an offset toward the first intake passage from a central position between central axis lines of the first intake passage and the second intake passage positioned on both sides of the gear unit, and a distance between the central axis line of the first spigot and the central axis line of the first intake passage is larger than a distance between the central axis line of the second spigot and the central axis line of the second intake passage.

5. The electronically controlled throttle device according to claim 2, wherein a plurality of intake passages are formed in each of the first throttle body and the second throttle body, and only central axis lines of the first spigot and the second spigot positioned on both sides of the gear unit out of spigots respectively formed in the engine-side end parts of the intake passages are eccentric in the direction away from each other.

6. The electronically controlled throttle device according to claim 2, wherein the gear unit is disposed to have an offset toward the first intake passage from a central position between central axis lines of the first intake passage and the second intake passage positioned on both sides of the gear unit, and a distance between the central axis line of the first spigot and the central axis line of the first intake passage is larger than a distance between the central axis line of the second spigot and the central axis line of the second intake passage.

7. The electronically controlled throttle device according to claim 3, wherein the gear unit is disposed to have an offset toward the first intake passage from a central position between central axis lines of the first intake passage and the second intake passage positioned on both sides of the gear unit, and a distance between the central axis line of the first spigot and the central axis line of the first intake passage is larger than a distance between the central axis line of the second spigot and the central axis line of the second intake passage.

8. The electronically controlled throttle device according to claim 5, wherein the gear unit is disposed to have an offset toward the first intake passage side from a central position between central axis lines of the first intake passage and the second intake passage positioned on both sides of the gear unit, and a distance between the central axis line of the first spigot and the central axis line of the first intake passage is larger than a distance between the central axis line of the second spigot and the central axis line of the second intake passage.

* * * * *